US005197186A

United States Patent [19]

Strong et al.

[11] Patent Number: 5,197,186

[45] Date of Patent: Mar. 30, 1993

[54] METHOD OF DETERMINING THE QUALITY OF A CRIMPED ELECTRICAL CONNECTION

[75] Inventors: Michael D. Strong, Mechanicsburg; Michael A. Yeomans, Camp Hill, both of Pa.

[73] Assignee: AMP Incorporated, Harrisburg, Pa.

[21] Appl. No.: 529,036

[22] Filed: May 29, 1990

[51] Int. Cl.[5] ..... H01R 43/04

[52] U.S. Cl. ..... 29/863; 29/705; 29/748; 29/753; 72/430; 72/465

[58] Field of Search ..... 29/863, 705, 753, 407, 29/857, 720, 748; 72/430, 431, 465

[56] References Cited

U.S. PATENT DOCUMENTS 4,294,006 10/1981 Bair et al. ..... 29/720 X
4,313,258 2/1982 Kindig et al. ..... 29/720 X
4,856,186 8/1989 Yeomans ..... 29/863
4,916,810 4/1990 Yeomans ..... 29/863
5,092,026 3/1992 Klemmer et al. ..... 29/705 X

*Primary Examiner*—Carl J. Arbes

[57] ABSTRACT

The present invention is a method of determining the quality of a crimped electrical connection by collecting force and displacement data during the crimping cycle and comparing that data with data that represents standard crimped connections of known high quality. Of the collected data, selected portions are related to corresponding portions of the standard data and, if a deviation exists of more than a specific amount, a reject signal is generated and displayed to the machine operator. The standard data is continually updated to account for slowly changing environmental conditions that occur over a relatively long period of operation.

15 Claims, 4 Drawing Sheets

METHOD OF DETERMINING THE QUALITY OF A CRIMPED ELECTRICAL CONNECTION

FIELD OF THE INVENTION

This invention relates to the termination of terminals to respective wires and to the controlling of the quality of such terminations.

BACKGROUND OF THE INVENTION

Terminals are typically crimped onto wires by means of a conventional crimping press having an anvil for supporting the electrical terminal and a die that is movable toward and away from the anvil for effecting the crimp. In operation, a terminal is placed on the anvil, an end of a wire is inserted into the ferrule or barrel of the terminal, and the die is caused to move toward the anvil to the limit of the stroke of the press, thereby crimping the terminal onto the wire. The die is then retracted to its starting point.

In order to obtain a satisfactory crimped connection, the crimp height and other characteristics of the crimped terminal must be closely controlled. The crimp height of a terminal is a measure of height or maximum vertical dimension of a given portion of the terminal after crimping. Ordinarily, if a terminal is not crimped to the correct crimp height for the particular terminal and wire combination, an unsatisfactory crimped connection will result. On the other hand many unsatisfactorily crimped connections will, nevertheless, exhibit a "correct" crimp height. A crimp height variance or other physical variation in the crimped terminal is not in and of itself the cause of a defective crimp connection, but rather, is indicative of another factor which causes the poor connection. Such factors include using the wrong terminal or wire size, missing strands of wire, wrong wire type, and incorrect stripping of insulation. Since such defective crimped connections frequently have the appearance of high quality crimped connections, it is difficult to identify these defects so that timely corrective action may be taken.

A simple non-destructive means of detecting such defective crimped connections by accurately measuring crimp height during the crimping process is disclosed in U.S. Pat. No. 4,856,186 which issued Aug. 15, 1989 to Yeomans and U.S. Pat. No. 4,916,810 which issued Apr. 17, 1990 to Yeomans, both of which are incorporated by reference as though set forth verbatim herein.

What is needed is an apparatus and method of use thereof which, utilizing the teachings of the above referenced patents, detects defectively crimped terminals by analyzing the crimping forces imposed on the terminal during the actual crimping operation.

SUMMARY OF THE INVENTION

The present invention is a method for determining the quality of the crimp of an electrical terminal crimped onto a wire. During the crimping operation, the amount of deformation of the terminal is measured along with the corresponding amount of force required to effect the deformation for several different amounts of deformation thereby defining a plurality of measured force and deformation data element pairs having a force value and a terminal deformation value. A plurality of standard data element pairs are provided which correspond to a known quality of crimp. Selected ones of the measured data element pairs are related to corresponding ones of the plurality of standard data element pairs, thereby determining the quality of crimp of the crimped terminal.

BRIEF DESCRIPTION OF THE PREFERRED EMBODIMENT

Figure 1:
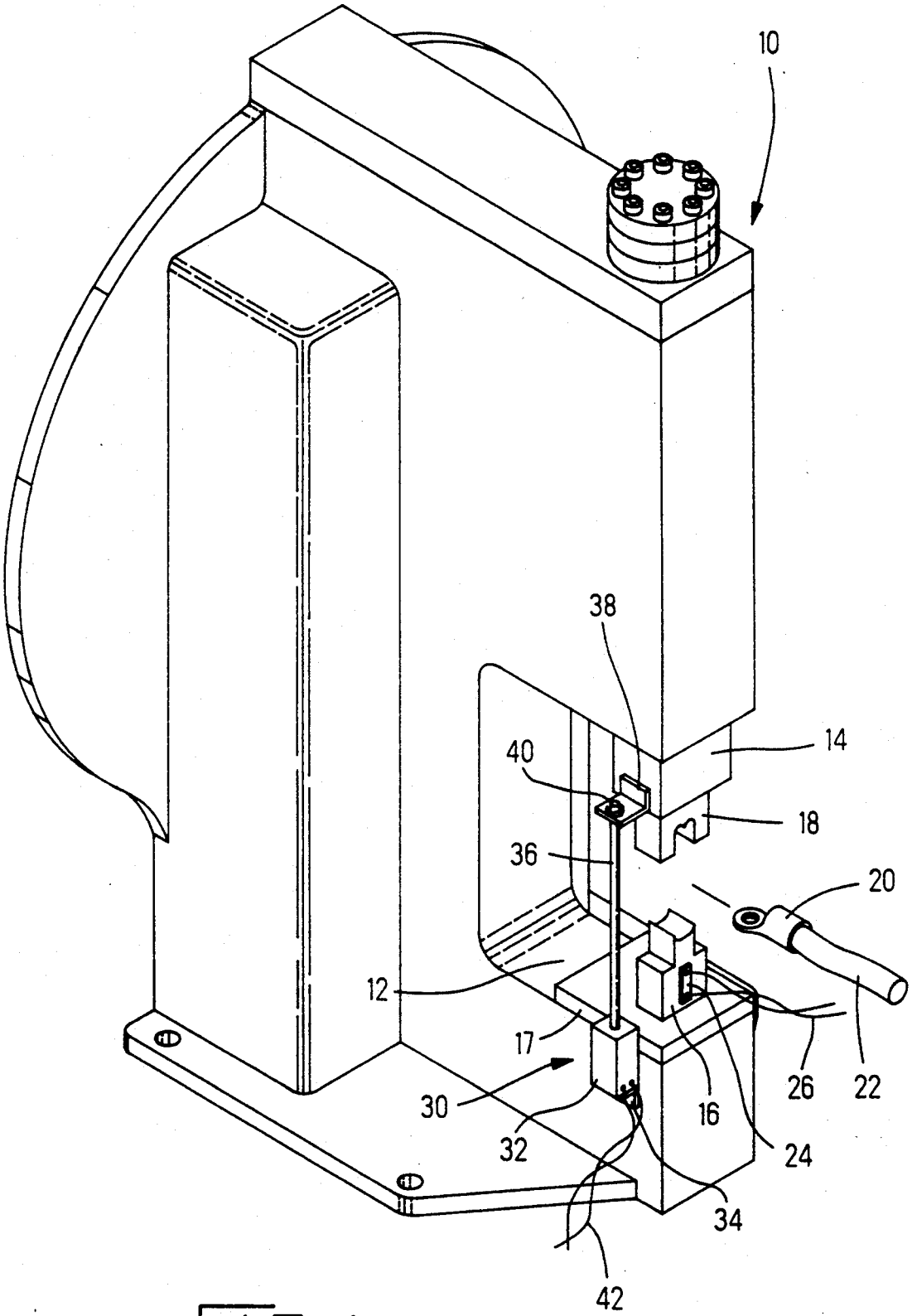
FIG. 1 is an isometric view of a crimping apparatus incorporating the teachings of the present invention.

There is shown in FIG. 1 a crimping press 10 having a base 12 and a ram 14 arranged for reciprocating opposed motion relative to the base 12. The crimping press 10, in the present example, is the type having a flywheel and clutch arrangement for imparting the reciprocating motion to the ram 14, however, other types of presses having a suitable ram stroke may by used in the practice of the present invention.

The base 12 and ram 14 each carry a mating half of a crimping die set in the usual manner. The die set includes an anvil 16 which is removably attached to a base plate 17 and a punch 18 which is removably attached to the ram 14, as shown in FIG. 1. The base plate 17 is coupled to the base 12 in a manner that will permit vertical movement of the plate 17. A typical terminal 20 is shown, in FIG. 1, crimped onto a wire.

As shown in FIG. 1, a strain gage 24 is attached to the anvil 16 in the usual manner by epoxy or soldering. A pair of leads 26 carry a signal that is proportional to the stress placed on the anvil 16 which is transferred from the ram 14, through the terminal 20 and wires 22 being crimped, to the anvil 16. The signal appearing on the leads 26 is indicative of the force imposed upon the terminal 20 during crimping, as set forth in more detail in the aforementioned '186 patent.

A linear distance sensor 30 is arranged to measure displacement of the ram 14 with respect to the base 12. The sensor 30 includes a stator 32, which is rigidly attached to the base 12 by a suitable bracket 34, and an armature which is movable within the stator in the vertical direction as viewed in FIG. 1. A push rod 36 projects upwardly from the stator 32 and has one end attached to the movable armature and the other end adjustably attached to the ram 14 by means of a suitable bracket 38 and adjusting nut 40. A pair of leads 42 carry a signal that is proportional to the vertical position of the armature within the stator. This signal is indicative of the vertical distance between the anvil 16 and the punch 18 as set forth in more detail in the 3 186 patent. As explained there, by monitoring the signals on the leads 26 and 42, the actual crimp height of the crimped terminal 20 can be accurately determined. It will be understood that the signal on the lead 42 is also indicative of the amount of deformation of the terminal being crimped by the anvil 16 and punch 18. Additionally, other parameters may be determined as well, such as peak force exerted on the terminal 20 and the amount of work performed to complete the crimp.

The method and apparatus for measuring force and ram displacement and generating their respective signals on the leads 26 and 42, as described above, is by way of example only. Any suitable devices that are well known in the art may be utilized for these functions. For example, permanent magnets may be associated with the ram and a hall effect device attached to the base and arranged to sense the relative position of the magnets in place of the sensor 30. Other suitable devices for sensing and signaling force ram displacement will occur to those skilled in the art and may be advantageously applied to practice the teachings of the present invention.

Figure 2:
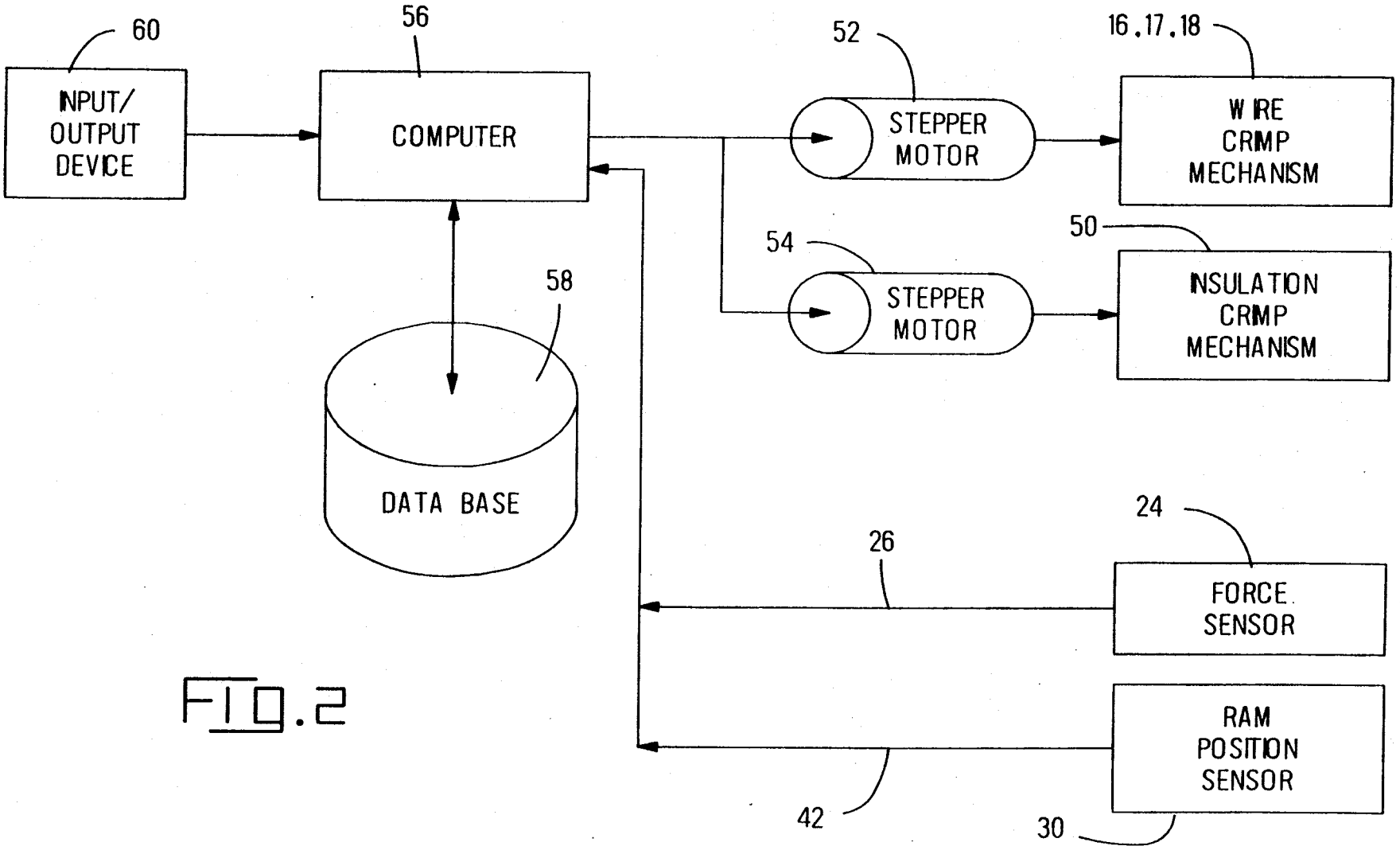
FIG. 2 is a block diagram showing typical functional elements employed in the practice of the present invention.

The major functions of the machine are shown in FIG. 2. Note that the wire crimping mechanism is identified as 16, 18, and 17 which represent the anvil, punch, and movable base plate respectively, and the force and ram position sensors are identified as 24 and 30 which represent the strain gage and linear distance sensor respectively. An insulation crimping mechanism 50 is depicted in FIG. 2 as an example of other instrumentalities that may be controlled in a manner similar to that of the wire crimping mechanism. Other similar instrumentalities may also be controlled in a similar way. The actual adjusting means which physically moves or adjusts the base plate 17, in the case of the wire crimp mechanism, or another adjustable device in the case of the insulation crimp mechanism, are driven by stepper motors 52 and 54 respectively. Any suitable actuator which can be driven through a computer input/output channel may be substituted for the stepper motors 52 and 54. A computer 56 having a storage device 58 associated therewith for storing a data base and an input/output device 60 for operator communication, is arranged to drive the stepper motors 52 and 54. This is done in response to operator input through the device 60 and input from either the force sensor 24 or the ram position sensor 30.

Figure 3:
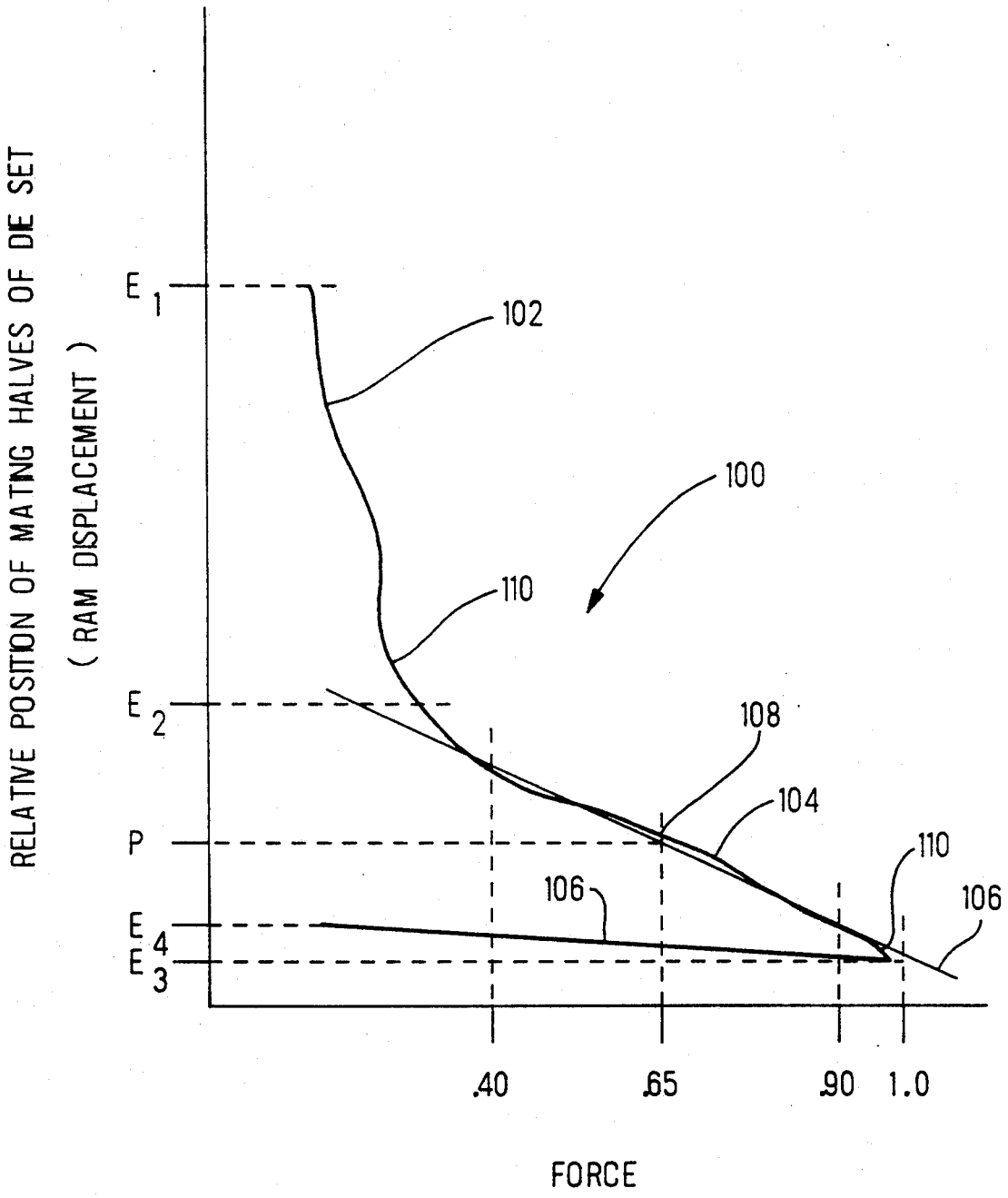
FIG. 3 shows a graph relating crimp force to ram displacement during the crimping of a terminal onto a wire.

The signal appearing on the leads 26, which is indicative of the force imposed upon the terminal, and the signal appearing on the leads 42, which is indicative of the relative position of the mating halves of the crimping die set 16 and 18, are monitored by the computer 56 and recorded on the storage device 58 in a manner that is well known in the art. These signals are recorded as pairs of data elements, one pair for each discrete increment of time during the crimping cycle, a rate of 4000 samples per second, for example, was successfully utilized in a test case of 90 crimped terminals of known quality, see Table 1. The precise number of samples recorded is unimportant as long as a samples are obtained to adequately define the work curve 100, as shown in FIG. 3, having a position axis and a force axis, where the area under the curve represents the total work done during the crimp cycle.

TABLE 1

| Sample No. | Condition | Signal Generated |
|---|---|---|
| 1 | Good | pass |
| 2 | Missing strands | reject |
| 3 | Insulation in crimp | reject |
| 4 | Insulation in crimp | reject |
| 5 | Insulation in crimp | reject |
| 6 | Good | pass |
| 7 | Missing strands | reject |
| 8 | Missing strands | reject |
| 9 | Good | pass |
| 10 | Insulation in crimp | reject |
| 11 | Insulation in crimp | reject |
| 12 | Missing strands | reject |
| 13 | Insulation in crimp | reject |
| 14 | Good | pass |
| 15 | Insulation in crimp | reject |
| 16 | Insulation in crimp | reject |

TABLE 1-continued

| Sample No. | Condition | Signal Generated |
|---|---|---|
| 17 | Missing strands | reject |
| 18 | Missing strands | reject |
| 19 | Insulation in crimp | reject |
| 20 | Insulation in crimp | reject |
| 21 | Missing strands | reject |
| 22 | Good | pass |
| 23 | Missing strands | reject |
| 24 | Good | reject |
| 25 | Insulation in crimp | reject |
| 26 | Missing strands | reject |
| 27 | Missing strands | reject |
| 28 | Good | pass |
| 29 | Missing strands | reject |
| 30 | Good | pass |
| 31 | Missing strands | reject |
| 32 | Missing strands | reject |
| 33 | Missing strands | reject |
| 34 | Insulation in crimp | reject |
| 35 | Good | pass |
| 36 | Missing strands | reject |
| 37 | Insulation in crimp | reject |
| 38 | Good | pass |
| 39 | Missing strands | reject |
| 40 | Good | pass |
| 41 | Insulation in crimp | reject |
| 42 | Insulation in crimp | reject |
| 43 | Insulation in crimp | reject |
| 44 | Good | pass |
| 45 | Missing strands | reject |
| 46 | Good | pass |
| 47 | Missing strands | reject |
| 48 | Good | pass |
| 49 | Good | pass |
| 50 | Insulation in crimp | reject |
| 51 | Good | pass |
| 52 | Insulation in crimp | reject |
| 53 | Missing strands | reject |
| 54 | Missing strands | reject |
| 55 | Missing strands | reject |
| 56 | Insulation in crimp | reject |
| 57 | Insulation in crimp | reject |
| 58 | Good | pass |
| 59 | Insulation in crimp | reject |
| 60 | Insulation in crimp | reject |
| 61 | Missing strands | reject |
| 62 | Insulation in crimp | reject |
| 63 | Missing strands | reject |
| 64 | Good | pass |
| 65 | Good | pass |
| 66 | Insulation in crimp | reject |
| 67 | Insulation in crimp | reject |
| 68 | Missing strands | reject |
| 69 | Missing strands | reject |
| 70 | Missing strands | reject |
| 71 | Good | pass |
| 72 | Missing strands | reject |
| 73 | Good | pass |
| 74 | Good | pass |
| 75 | Good | pass |
| 76 | Good | pass |
| 77 | Good | pass |
| 78 | Missing strands | reject |
| 79 | Good | pass |
| 80 | Insulation in crimp | reject |
| 81 | Good | pass |
| 82 | Insulation in crimp | reject |
| 83 | Insulation in crimp | reject |
| 84 | Good | pass |
| 85 | Missing strands | reject |
| 86 | Insulation in crimp | reject |
| 87 | Insulation in crimp | reject |
| 88 | Good | pass |
| 89 | Good | pass |
| 90 | Missing strands | reject |

Alternatively, the samples may be taken based upon incremental changes in the values of either relative position or force instead of increments of time. The important consideration is that a sufficient number of samples are obtained to adequately define the work curve 100.

Figure 4:
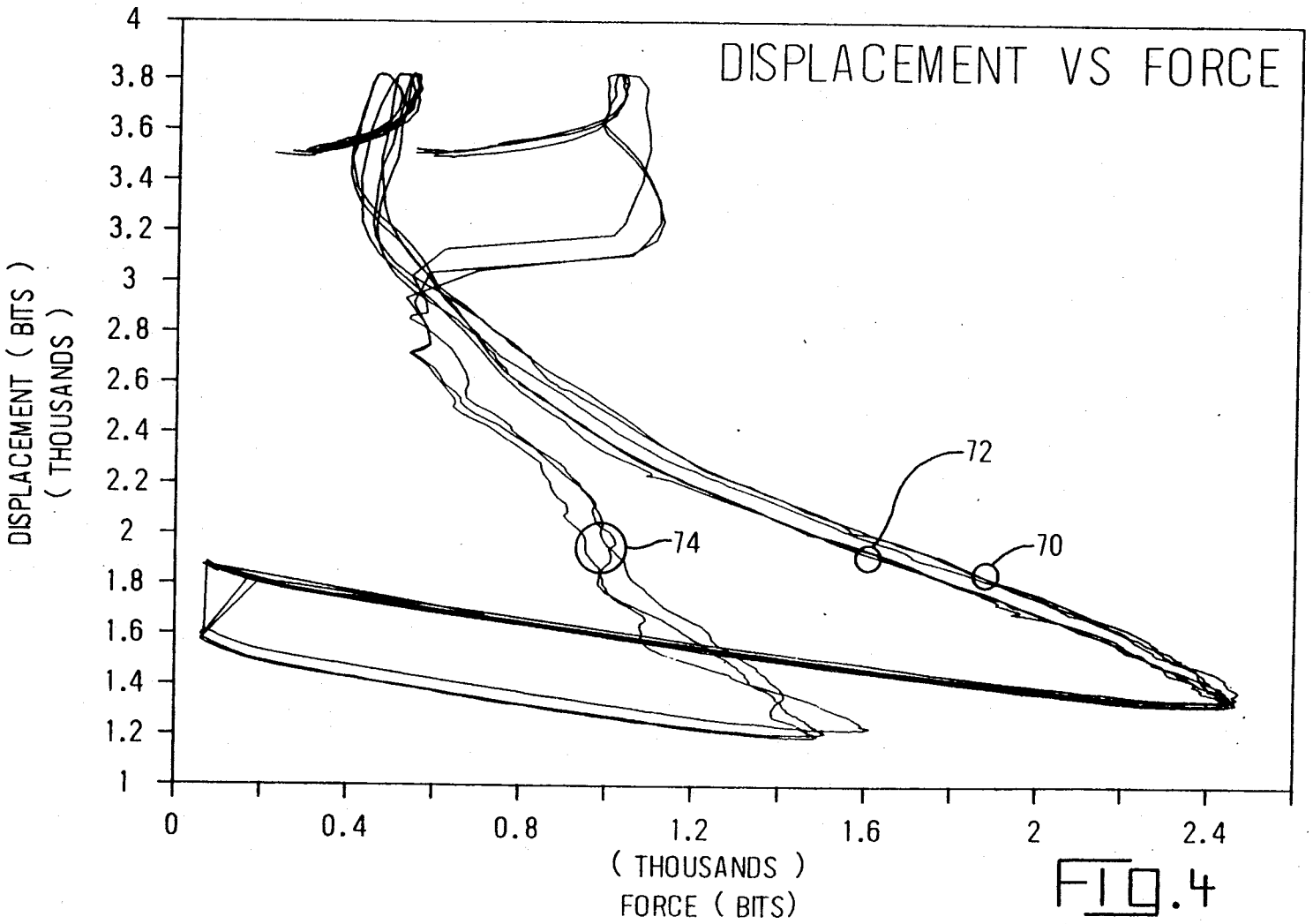
FIG. 4 shows actual plotted graphs of selected crimped terminals.

FIG. 4 shows several curves, which were plotted from various sets of data element pairs of selected test sample terminations to illustrate the effects of missing strands and of insulation included in the crimped connection. As can be seen from a close inspection of FIG. 4, there are nine discrete curves plotted in three groups of three curves each. The first group of curves indicated at 70 represents crimped connections of known high quality. The second group of curves indicated at 72 represents crimped connections having four missing strands from a 41 strand wire, and the connections having portions of insulation within the crimped connection. The reason that the curves 74 have such a low peak force is that the insulation serves as a lubricant, causing individual strands of wire to break and slip out of the terminal being crimped.

The curve 100, shown in FIG. 3, is a plot of a set of data element pairs which, hypothetically, represent the work curve of the crimping operation of a typical crimped terminal. The portion 102 of the curve, between the points E1 and E2 on the position axis, mating die halves engaging the terminal 20 and beginning to deform it. Beyond the point E2 until the point E3, is represented by the portion 104 of the curve. The force reaches its peak at E3 where the punch 18 begins to disengage by withdrawing from the anvil 16. This disengagement, which is represented by the portion 106 of the curve, continues from the point E3 to the point E4 where the force has receded to substantially zero. No data element pairs need be collected as the punch 18 approaches the point E1 and recedes from the point E4 since no work is performed on the terminal 20 during these movements of the punch.

The portion of the curve 102 that is most significant in indicating defects in the crimped connection such as, for example, missing strands or wrong size of wire or terminal is the portion 104. The portion 104 shows a relatively sharp and somewhat linear increase in force. A group of data element pairs are selected from those that define the portion 104 having a force value between about 35 to 40 percent and about 90 to 95 percent of the peak force at the position E3. These force value percentage limits are not critical as long as the group of selected data elements does not include either of the portions 110 of the curve 102 that deviate significantly from the general linearity of the portion 104. This group of data element pairs is analyzed and compared to a standard group of pairs taken during a known high quality crimp cycle to determine the quality of the present crimped connection.

One method of doing this is to fit a straight line to the group of pairs by means of the "least squares" method, which method is well known in the art. By way of background, the "least squares" method is performed as follows:

For a set of n points of the form $(F_1,P_1)$ the slope m and intercept b of the straight line are given by $$m = \frac{1}{d}\left(n \sum_{i=1}^{n} F_iP_i - \sum_{i=1}^{n} F_i \sum_{i=1}^{n} P_i\right)$$

$$b = \frac{1}{d}\left(\sum_{i=1}^{n} F_i^2 \sum_{i=1}^{n} P_i - \sum_{i=1}^{n} F_i \sum_{i=1}^{n} F_iP_i\right)$$

-continued $$d = n \sum_{i=1}^{n} F_i^2 - \left(\sum_{i=1}^{n} F_i\right)^2$$

Once a straight line 106 is defined that best fits the group of data element pairs, as seen in FIG. 3, the point 108 on the line that corresponds to a force value equal to about the average of the minimum and maximum values of the force data elements in the group is found. This is indicated as the 65 percent point along the force axis. The corresponding point along the position axis is then found and indicated as P on the position axis. It is this point P that can be compared to a similarly found, but statistically evolved, point P' of a number of known high quality terminations and a valid judgment made as to the quality of the crimp represented by the point P.

The point P' may be determined by preparing a suitable number of correctly stripped wires and associated terminals to be crimped thereto. Each wire and corresponding terminal is placed, in turn, in crimping position within the press 10 and crimped while recording the data element pairs representing the work curve resulting in a set of standard force and position data element pairs. The position P is then calculated as set forth above in the description of FIG. 3. After each such crimp operation, the crimped connection is manually examined for quality of crimp. In the event that the crimped connection is not of high quality, the corresponding data element pairs are purged from the memory device 58. When a suitable number of high quality crimped connections are formed, five in the present example, the mean P' of the five P value and the standard deviation are calculated.

In operation the machine 10 is calibrated by determining the mean P', as set forth above, and storing it along with the calculated standard deviation in the storage device 58. Thereafter, every production crimp cycle will be compared to this stored standard of known high quality to determine the quality of the production termination.

During every production crimp cycle, the signals appearing on the leads 26 and 42 are recorded as measured data element pairs on the storage device 58. A group of measured data element pairs is selected from those that define the portion 104 of the curve 102 and have a force value of between about 35 percent and about 95 percent of the peak force F at the position E3. In the present example, a straight line is fitted to the group of measured pairs and the point P is determined in a manner set forth above. This point P is compared with the calculated mean P' and a reject signal is generated by the computer 56 and displayed on the input/output device 60 if the point P is not within a predetermined number of standard deviations of the mean P'. In the present example three standard deviations were used. If the point P is within this limit the corresponding crimped connection is considered to be of acceptable quality.

Optionally, at this point, if no reject signal is generated, the group of measured data element pairs may be factored into the calculated mean P' and associated standard deviation so that subsequent comparisons will involve the new mean P'. This is useful where the machine 10 will be subject to slowly changing environmental conditions, such as temperature changes, or other changing conditions over a relatively long period of operation. Under such changing conditions the calibration must be continually updated to remain valid. The factoring of the group of measured data element pairs into the calculated mean P' can be effected in any suitable manner such as by including the group of measured pairs as a set with the sets of standard force and position data element pairs previously used to calculate the mean P' and standard deviation and these variables recalculated.

The method described above for comparing the group of measured data element pairs to a group of standard pairs by fitting a straight line thereto yields excellent results, however, the same technique may be successfully employed by fitting a known curved line to the group of pairs. Other suitable methods of comparing the group of measured pairs with the group of standard pairs will become apparent to the skilled art worker upon reading this disclosure, and such methods are considered to be within the spirit and scope of the claims appended hereto.

An important refinement of the above described method of determining the quality of a crimped connection is the inclusion of the peak force F in the comparison of the group of measured pairs with the group of standard pairs.

A mean F' and standard deviation of the peak force is calculated for the set of known high quality terminations that were used to calculate the mean P' and stored on the storage device 58 during calibration of the machine 10, as set forth above. During the production crimp cycle, when the group of measured data element pairs is selected, the peak force F at the position E3 of the curve 102 is also selected and compared with the calculated mean F' and a reject signal generated by the computer 56 and displayed on the input/output device 60 if the force F is not within a specified interval of the mean F'. In the present example, 3 standard deviations of F' was used, however, other intervals may be useful for detecting specific deficiencies such as insulation within the crimped connection. As stated above, the group of measured data element pairs may be factored into the calculation of the mean P' if no reject signal is generated.

Similarly, the measured force F may also be factored into the mean F' thereby accounting for slowly changing environmental conditions over a relatively long period of operation.

An important advantage of the present invention is the capability to detect missing strands from a crimped connection or the inclusion of insulation therein immediately after the crimping cycle is completed and a reject signal automatically generated prior to the next crimping operation. This capability may be integrated into an automated machine where each crimped connection is evaluated for quality of crimp and those that do not meet the standard can be automatically discarded. This can be done during production without adversely affecting the running speed of the machine.

We claim:

1. In a method of determining the quality of the crimp of an electrical terminal crimped onto a wire utilizing crimping apparatus which includes a press having a base and a ram arranged for opposing relative reciprocating motion, said base and ram each carrying a mating half of a crimping die set, the steps comprising:

(a) placing a terminal and wire in crimping position within said crimping apparatus;

(b) causing at least one of said base and said ram to undergo relative motion so that said die set engages, crimps said terminal onto said wire, and disengages;

(c) during said engaging, crimping, and disengaging of step (b), simultaneously measuring both the distance between the terminal engaging portions of said die set and the force applied to said terminal by said die set for a plurality of different relative positions of said mating halves of said die set thereby defining a plurality of measured force and position data element pairs having a force value and a position value respectively;

(d) providing a plurality of standard data element pairs corresponding to a known quality of crimp; and (e) relating selected ones of said plurality of measured data element pairs to corresponding ones of said plurality of standard data element pairs thereby determining the quality of crimp of said crimped terminal.

2. The method according to claim 1 wherein said selected ones of said plurality of measured data element pairs of step (e) includes a first group of said pairs defined only during said engaging and crimping of step (c) and having a force value of between about 35 percent and about 95 percent of the maximum measured force of said plurality of data element pairs.

3. The method according to claim 2 wherein said relating of step (e) includes the steps:

(e1) performing a least squares fit of said first group of data element pairs to a straight line;

(e2) calculating a position P corresponding to a point on said straight line having a force value F equal to about the average of the maximum and minimum measured forces; and (e3) comparing said calculated position P of step (e2) with the position value of a corresponding data element pair of said plurality of standard data element pairs having a force value substantially equal to F.

4. The method according to claim 3 wherein said providing a plurality of standard data element pairs of step (d) includes;

(d1) providing a known good terminal and a properly stripped wire and placing said terminal and wire in crimping position within said crimping apparatus;

(d2) causing at least one of said base and said ram to undergo relative motion so that said die set engages, crimps said terminal onto said wire, and disengages;

(d3) during said engaging, crimping, and disengaging of step (d2), simultaneously determining both the distance between the terminal engaging portions of said die set and the force applied to said terminal by said die set for a plurality of different relative positions of said mating halves of said die set, thereby defining a plurality of standard force and position data element pairs;

(d4) repeating steps (d1), (d2), and (d3) at least once, thereby defining a sample of at least two sets of said standard force and position data element pairs;

(d5) selecting a group of adjacent pairs from each said set;

(d6) performing a least squares fit to a straight line of said group of pairs for each set;

(d7) for each straight line calculating a position P corresponding to a point on said straight line having a force value F equal to about the average of the minimum and maximum forces of said data element pairs in the set corresponding to said straight line;

(d8) calculating the mean P' and standard deviation of the positions P for said sample.

5. The method according to claim 4 wherein said selecting a group of pairs of said pairs defined only during said engaging and crimping of step (c) and having a force value of between about 35 percent and about 95 percent of the maximum force, or peak force of said plurality of data element pairs for each set in said sample;

6. The method according to claim 5 wherein said comparing of step (e3) includes comparing said calculated position P of said measured data element pairs with said calculated mean P' of said sample.

7. The method according to claim 6 including the step:

(f) providing a reject signal if the calculated position P of said measured data element pairs is more than a predetermined number of standard deviations from said calculated mean P'.

8. The method according to claim 7 including the step:

(d7) calculating the mean F' and standard deviation of the maximum force values for the sets of data element pairs in said sample, and wherein said comparing of step (e3) includes comparing the maximum force of said measured data element pairs with said calculated mean F' of the maximum force of said sample.

9. The method according to claim 8 wherein step (f) includes providing a reject signal if the maximum force of said measured data element pairs is more than a predetermined number of standard deviations from said calculated mean F' of the maximum force of said sample.

10. The method according to claim 9 including the step:

(g) if said reject signal of step (f) is not provided then recalculating the mean P' and standard deviation of the positions P for the sample as though said sample had included said first group of said pairs of step (e) as an additional set.

11. In a method of determining the quality of the crimp of an electrical terminal crimped onto a wire, the steps:

(a) during the crimping of said terminal onto said wire, measuring the amount of deformation of said terminal and simultaneously measuring the corresponding amount of force required to effect said deformation for a plurality of different amounts of said deformation, thereby defining a plurality of measured force and deformation data element pairs having a force value and a terminal deformation value;

(b) providing a plurality of standard data element pairs corresponding to a known quality of crimp; and (c) relating selected ones of said plurality of measured data element pairs to corresponding ones of said plurality of standard data element pairs; thereby determining the quality of crimp of said crimped terminal.

12. The method according to claim 11 wherein said crimping of step (a) is effected by a crimping apparatus having two mating halves of a crimping die set arranged to move toward one another for engaging and crimping said terminal onto said wire, and to move in an opposite direction for disengaging, and wherein said measuring the amount of deformation of said terminal of step (a) comprises measuring the relative position of said two halves of said die set and each said deformation data element of said pairs comprises a position value representing said relative position.

13. The method according to claim 12 wherein said selected ones of said plurality of measured data element pairs of step (c) includes a first group of said pairs defined only during said engaging and crimping of step (a) and having a force value of between about 35 percent and about 95 percent of the maximum measured force of said plurality of data element pairs.

14. The method according to claim 13 wherein said relating of step (c) includes the steps:

(c1) fitting a line to said first group of data element pairs;

(c2) calculating a position P corresponding to a point on said line having a force value equal to about the average of the minimum and maximum force values of said first group of data element pairs; and (c3) comparing said calculated position P of step (c2) with the position value of a corresponding data element pair of said plurality of standard data element pairs having a force value substantially equal to said average force value.

15. The method according to claim 14 wherein said line in step (c1) is a straight line.

* * * * *